US007357595B1

(12) United States Patent
Pfaff

(10) Patent No.: US 7,357,595 B1
(45) Date of Patent: Apr. 15, 2008

(54) PAVEMENT REMOVAL MACHINE

(75) Inventor: Deems M. Pfaff, Vail, CO (US)

(73) Assignee: Road Processing Resources, Inc., Golden, CO (US)

( * ) Notice: Subject to any disclaimer, the term of this patent is extended or adjusted under 35 U.S.C. 154(b) by 217 days.

(21) Appl. No.: 11/247,821

(22) Filed: Oct. 11, 2005

Related U.S. Application Data

(60) Provisional application No. 60/618,067, filed on Oct. 12, 2004.

(51) Int. Cl.
*E01C 23/12* (2006.01)

(52) U.S. Cl. ..... 404/92; 404/83; 404/84.1; 404/90

(58) Field of Classification Search ..... 404/90, 404/94, 83, 84.1, 92; 180/9.46
See application file for complete search history.

(56) References Cited

U.S. PATENT DOCUMENTS 3,664,448 A * 5/1972 Hudis ..... 180/9.46
4,029,165 A * 6/1977 Miller et al. ..... 180/6.48
4,120,507 A * 10/1978 Miller ..... 280/6.154
4,174,757 A * 11/1979 Stedman ..... 172/292
4,309,126 A * 1/1982 Pfaff ..... 404/90
4,433,952 A * 2/1984 Glickman ..... 414/460
4,560,207 A * 12/1985 Eftefield et al. ..... 299/10
4,692,058 A * 9/1987 Mengel ..... 404/72
5,026,205 A * 6/1991 Gorski et al. ..... 404/72
5,028,170 A * 7/1991 Gorski et al. ..... 404/72
5,451,135 A * 9/1995 Schempf et al. ..... 414/694
5,664,907 A * 9/1997 Betsinger ..... 404/90
6,286,615 B1 * 9/2001 Bitelli ..... 180/9.46
2003/0222432 A1 * 12/2003 Bowers et al. ..... 280/677

* cited by examiner

*Primary Examiner*—Thomas B. Will
*Assistant Examiner*—Alina Schiller
(74) *Attorney, Agent, or Firm*—Steven E. Kahm, Esq.; Nikolai & Mersereau, P.A.

(57) ABSTRACT

Portland Cement Concrete with steel reinforcement mats or rods used in airport runways, highways, and other objects need to have the cement broken up for recycling or disposal and the steel mat reused or the steel recycled. The pavement removal machine lifts the concrete off a roadbed and places it on an anvil. A hammer then cracks the concrete and breaks it into small pieces, which fall away from the reinforcing steel. The concrete and the steel are then recycled. The pavement removal machine has legs which are moveable between a road working position and a transport position and can translate the frame of the machine up and down. The hammers can be gravity drop or powered. The steel can be cut into sections as the pavement is continuously torn up at a rate of about 1 lane mile per day.

15 Claims, 4 Drawing Sheets

PAVEMENT REMOVAL MACHINE

BACKGROUND OF THE INVENTION

1. Field of the Invention

This invention relates to a machine for pulverizing concrete sheets or slabs, and more particularly to a machine for pulverizing concrete roadbeds having reinforcing steel therein, where the machine is moved along the roadbed during the pulverizing operation. The machine recycles the roadbed by reducing it to concrete aggregate and scrap steel. It accomplishes in one operation that now requires six steps in removal of deteriorated concrete roads.

2. Description of Related Art

The replacement of concrete roadways creates a unique and troublesome disposal problem whenever large and bulky concrete slab or sheet structures must be removed from the work site. Such large structures are unsuitable for disposal in landfills unless broken up into small pieces because they tend to create voids underground which prevent adequate filling and compaction. While air and hydraulic hammer machines have been developed to break up such concrete structures into smaller pieces, these machines are particularly unsuitable when the concrete has reinforcing steel embedded therein. Even after hammering, concrete tends to adhere to the steel, resulting in tangled steel and concrete debris, which is difficult to move and dispose of. The reinforcing steel itself is usually not reclaimable because of the exceedingly high concrete content that adheres to it. This material is typically trucked to remote disposal sites for inadequate disposition, for no better disposal or recycling program is known for such material. The hauling of this material to remote sites adds to the cost of reconstruction, and the loss of the steel and concrete material for recycling creates a needless economic loss to the owner of the material.

In the reconstruction of roadbeds the old concrete roadbed is typically hammered by means of machines to reduce the size of the concrete and steel fragments to manageable proportions, and these fragments are hauled away. The new roadbed is then filled and graded, and new concrete and reinforcing steel are applied to create a new road. A significant proportion of the total cost of building such a road is attributable to the cost of removing the old roadway, and no significant return is achieved through any recycling process.

Current road removal of deteriorated concrete roads involves a multiple step process for removing the old concrete road. First the concrete road is cracked such as by a plurality of jackhammers, then a "rhino horn" device lifts up the cracked roadbed. Then the steel rods or mesh is sawed or burned through to create sections of roadbed. The sections can be hauled to a landfill or a crusher caravan can first crush the concrete roadbed sections to a primary size aggregate and then a secondary crusher reduces the size of the aggregate to a desired size and the steel rods or mesh can be separated. Each of the above steps requires a different piece of equipment in a caravan traveling down the road and is labor intensive. What is needed is a machine to process old steel reinforced concrete roadbeds into concrete aggregate and recyclable scrap steel by continuously pulling up the roadbed, reducing the concrete recyclable concrete aggregate and separating out the steel mesh or rods as the machine travels along the road.

In the applicant's prior U.S. Pat. No. 4,309,126 a machine for separating concrete from steel for tearing up a roadbed and recycling it was presented. The machine used a wedge to pick the concrete pavement off the roadbed and lift it to an anvil for presentation to hammers, which removed the concrete from the steel reinforcing rods however the steel reinforcing rods would have to be disassembled for recycling which was labor intensive. Further the reinforcing rods were forced up over the driver on top of the machine, which required a ramp and a considerable amount of energy to force the steel rods up and over the top of the machine. There were many drawbacks to having the steel passing over the top of the machine such as inhibiting turns, weight, limitations of machine configuration due to height and possible safety issues. Further, the tracks on the machine were aft of the wedge, which is not ideal. It is better to pull the wedge under the pavement than to push it. Further the tracks were in a fixed position which made it harder to transport the machine since it is necessarily wider than a lane of a roadway and was longer than wide. The hammers in the applicant's prior machine had a small footprint and the hammers had to traverse the surface of the road for the foot of each hammer to impact on the entire surface of the pavement.

SUMMARY OF THE INVENTION

The pavement removal machine has a main body which is narrow such that it can be turned sideways for transport on a trailer over roadways to get to different sites. The legs of the pavement removal machine are supported by arms which can pivot to change the machine configuration from the road working mode to the transport mode. Further the legs can be moved up and down to lift the machine onto or off of a trailer and to adjust the wedge and anvil position relative to the pavement. The pavement removal machine in its operational purpose lifts the pavement from the roadbed by the tracks on the front legs pulling the wedge and anvil under the pavement and lifting it up for the hammers to pulverize the concrete while it rests on the anvil and breaks most of the concrete up into small pieces which fall away from the steel reinforcing rods in the pavement. The concrete is then transported by conveyor belts to the side of the road or onto trucks on the side of the pavement removal machine for transport to a concrete recycling facility. The steel is cut into sections of 4-5 feet lengths and placed in a container aft of the conveyors and the containers can be easily removed and replaced for hauling loaded containers to a scrap recycling facility to reuse the steel.

OBJECTS OF THE INVENTION

It is an object of the invention to provide an easily to assemble and disassemble, transportable design for a pavement removal machine.

It is an object of the invention to strip concrete by shock fracture from the steel reinforcing rods or mesh and cut the rods into manageable lengths on the pavement removal machine and store the cut lengths of steel in a container towed by the pavement removal machine.

It is an object of the invention to allow the pavement removal machine to be quickly readied to tear up and recycle reinforced concrete pavement after it is transported to the site.

It is an object of the invention to allow the pavement removal machine to be quickly and easily loaded on to a trailer for transport.

It is an object of the invention to separate the pavement removal machine into a tractor component, a wedge and anvil component and conveyors for ease of transporting the pavement removal machine by sections.

It is an object of the invention to quickly remove and recycle pavement.

It is an object of the invention to provide hammers which can quickly shock fracture concrete for the lane width of the road.

It is an object of the invention to increase the efficiency of pavement removal machines.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
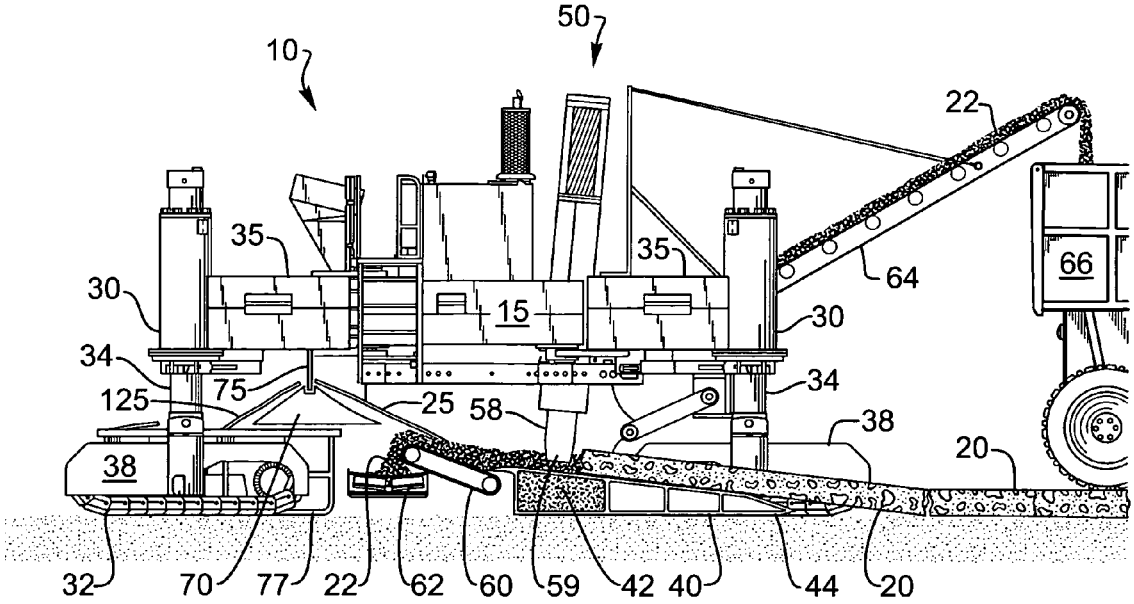
FIG. 1 is a side view of the pavement removal machine recycling a roadbed.
Figure 2:
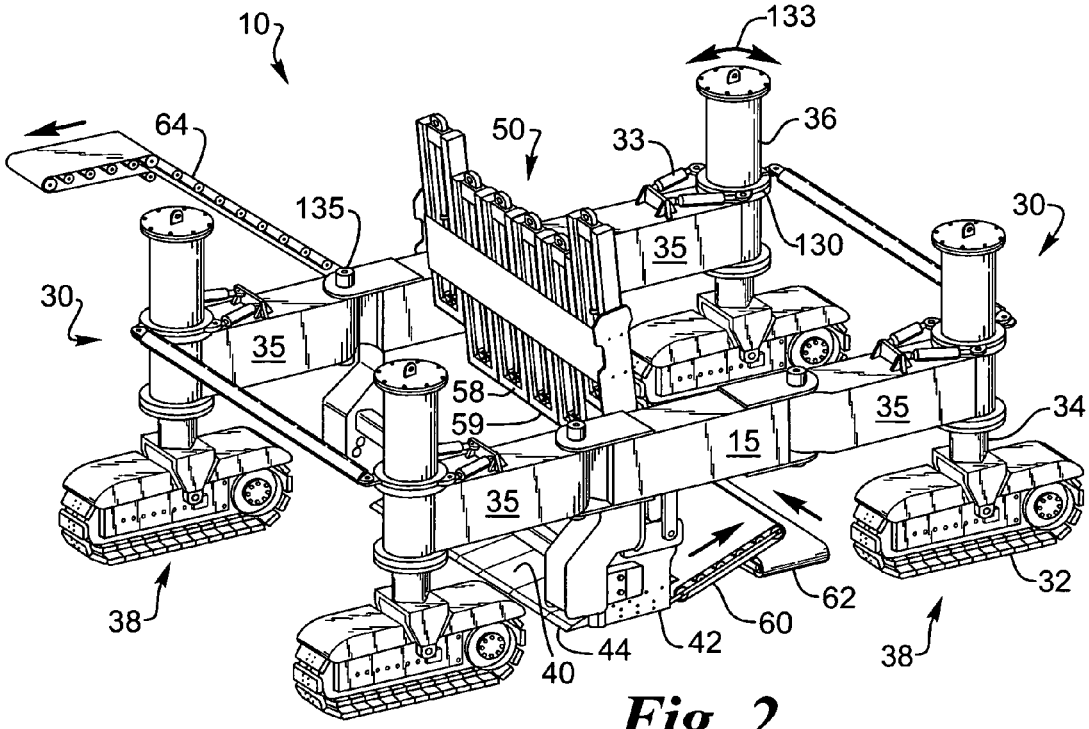
FIG. 2 is a front right hand perspective view of the pavement removal machine.
Figure 3:
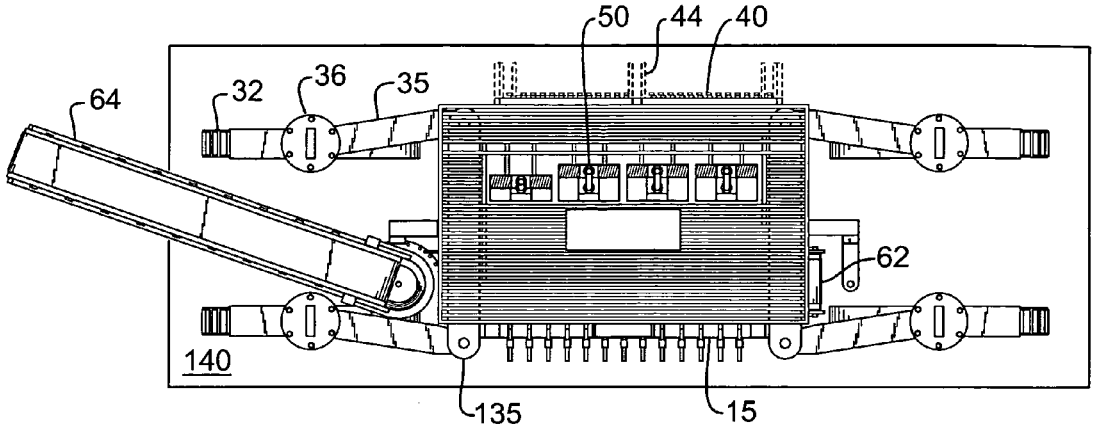
FIG. 3 is a top view of the pavement removal machine with the legs rotated for transport on a flatbed trailer.
Figure 7:
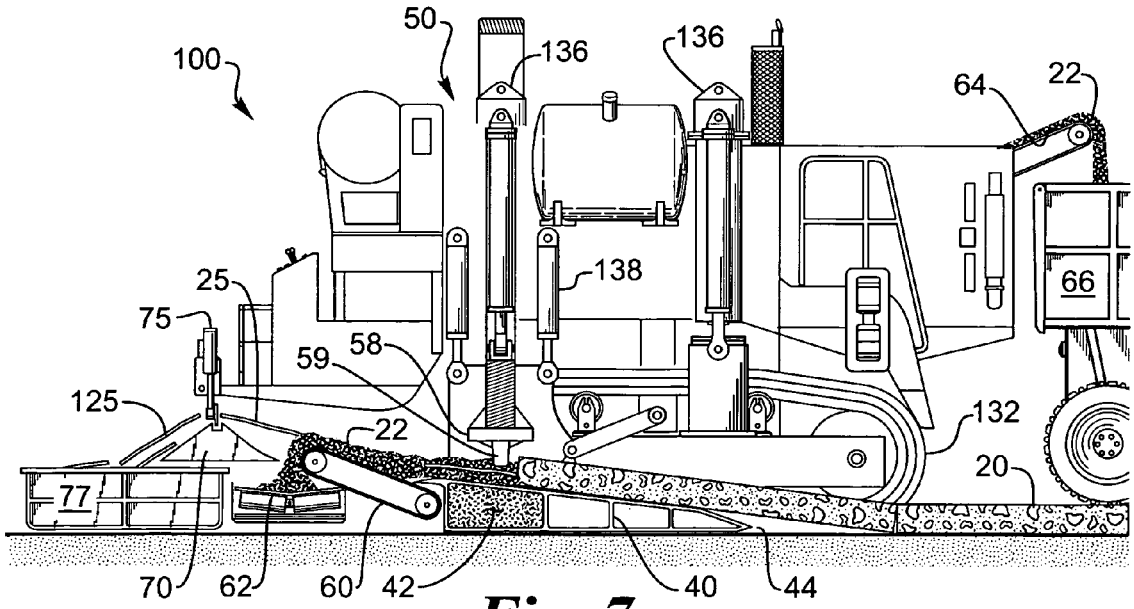
FIG. 7 is a side view of the pavement removal machine of FIG. 5 for producing concrete aggregate and recycling scrap steel and uses a 2-crawler tractor for certain operations such as exits and entrances.

The pavement removal machine 10 is shown generally in FIGS. 1-3. The pavement removal machine 10 is designed to take pavement 20 composed of concrete 22 with steel reinforcement rods or steel mesh 25 therein and lift the pavement 20 off the roadbed by use of a wedge 40 which goes under the pavement 20 and lifts it up as the pavement removal machine 10 is propelled forward. The concrete 22 in the pavement 20 begins to crack as it is forced upward by the wedge 40. The concrete 22 is pushed upward along the wedge 40 until it reaches an anvil 42 at the rear of the wedge 40. The anvil 42 supports the concrete 22 with steel rod 25 reinforced pavement 20 such that a hammer 50 can impact on the concrete 22 which is between the hammer 50 and the anvil 42. The hammer blows first crack the concrete 22 by shock and then separates the concrete into small pieces, which are pushed forward and falls onto a discharging conveyor, as best seen in FIGS. 3 and 7, onto a conveyor belt 60 and lifted unto a transverse conveyor belt 62 and moved to the side of the road or placed on a conveyor 64 for lifting into a truck 66 for hauling the concrete 22 away. The concrete 22 can then be recycled for use in a concrete mixture for the new roadway at the site or for use at another location. The concrete 22 will largely be debonded, in response to shock, from the steel reinforcing rods 25 and the steel rods or mesh will be taken up by saw table 70 and cut into sections by saw 75. The sections 125 of cut reinforcing will then fall into container 77 which will be hauled away to a steel recycling center to reuse the steel.

In the embodiment shown in FIGS. 1-3, the pavement removal machine 10 has moveable legs 30 have pistons 34 which can be raised up and down to raise or lower the main body 15 of the pavement removal machine 10 such that it can be raised to put the main body 15 on a flat bed trailer 140 and then the pistons 34 raised for transporting the pavement removal machine 10 to another location. The arms 35, which support the legs 30 rotate on pivots 135 and can be rotated 90 degrees such that the legs 30 can be aligned for transport on the flatbed trailer 140 as shown in FIG. 3. When the pavement removal machine 10 is transported to a site for work the arms 35 are extended such that the legs 30 straddle the pavement 20 to be torn up and recycled. The pistons 34 on legs 30 can then be raised so that the transport trailer 140 can be removed and then the pistons 34 on legs 30 can be lowered to put the pavement removal machine 10 in position to work on the pavement 20 and to maintain proper level of engagement with the pavement 20 to be processed.

Figure 4:
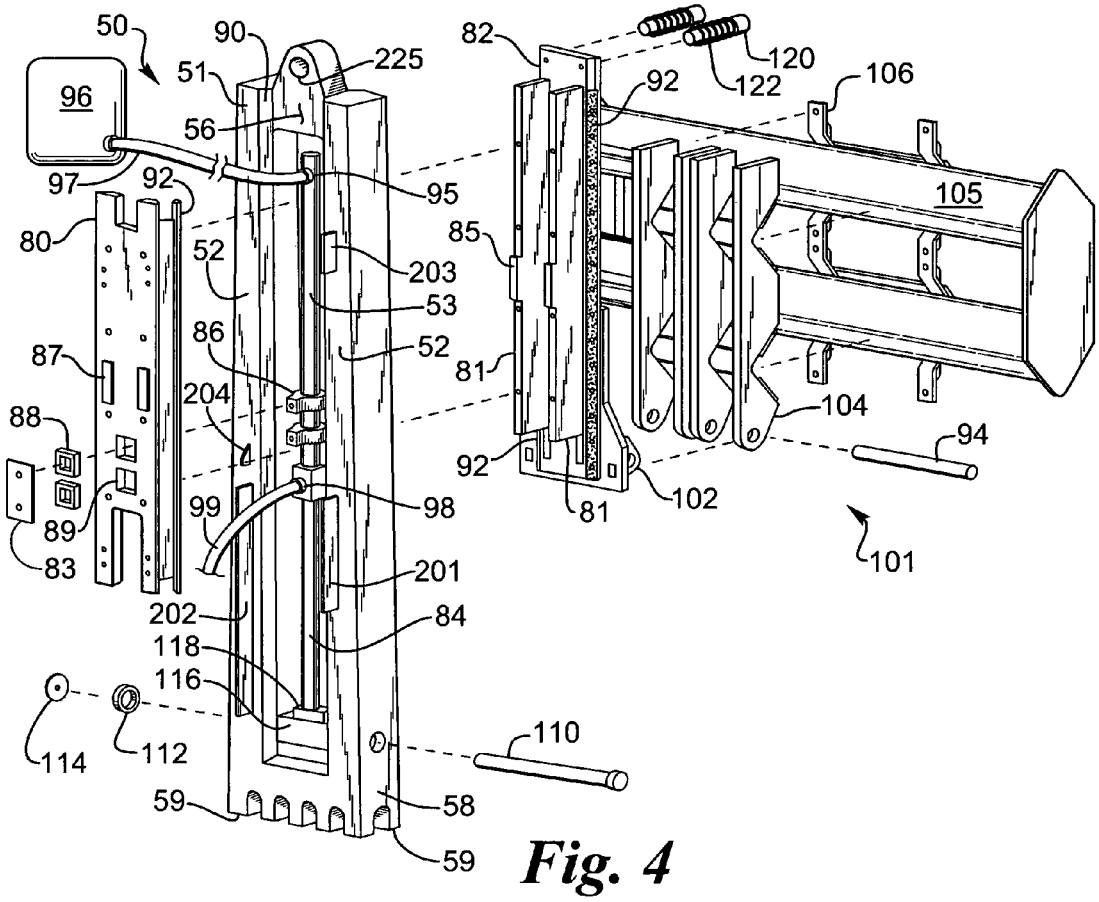
FIG. 4 is an exploded view of a hammer.

The hammers 50 and the conveyors 62 and 64 may be removed from the pavement removal machine 10 for transportation since the hammers may protrude too high and the conveyors 62 and 64 may be too wide for the trailer 140. The hammers 50 and conveyors 62 and 64 may be easily reassembled on the pavement removal machine when it arrives at a new site. Alternatively, as shown in FIG. 4, the hammer assembly 50 may be pivoted on mounting hinge assembly 101 to tilt the hammer mass 51 down for transport or for maintenance.

The conveyor 64 can be pivoted to different positions to load trucks or for transporting the pavement removal machine 10 with the conveyor in a position parallel to the length of the trailer 140.

Legs 30 have pistons 34 which are raised or lowered by hydraulic cylinders 36. The legs 30 are supported by pods 38 connected to pistons 34. The pods 38 have hydraulic powered tracks 32 thereon to propel the pavement removal machine 10. The pods 38 can be steered by use of steering pistons 33 connecting the arms 35 to the outside of the housing 130 for legs 30. The steering pistons 33 can rotate the pods 38 as shown by arrows 133 to steer the pavement removal machine 10. The track pods 38 can also be individually controlled to augment steering.

The legs 30 can also be adjusted to locate the tracks 32 in position relative to the wedge 40 and anvil 42 such that the wedge can force the pavement 20 upward as all four tracks 32 push and pull the pavement removal machine 10 forward thus lifting the pavement 20 on the wedge 40. Hydraulic motors (not shown) in the track pods 38 power the tracks 32 for propelling the pavement removal machine 10. The tracks 32 may be individually controlled for skid steering.

The wedge 40 and anvil 42 may have many different designs. As best seen in FIG. 2 the leading edge 44 of the wedge 40 can have a pointed portion and may support a plate thereover. The wedge 40 has a plate thereover for the pavement to slide on as it is forced upward. The anvil 42 has a steel plate thereover such that it forms a solid surface on which the pavement 20 may rest as it receives hammer blows from hammer 50 to break up the concrete 22. The anvil 42 must be strong enough to absorb the hammer blows and reflect the energy in the blows back through the concrete 22 so as to help break up the reinforced concrete pavement 20. The hammer blows are sequenced such that the anvil 42 will respond to one blow at a time.

The leading edge 44, wedge 40 and anvil 42 are all connected by pivots such that they can form different angles relative to one another. It may be advantageous to have the leading edge 44 pointed at a different angle than the wedge 40 to have a smaller angle of incidence with the base of the pavement 20 and such that the points of the leading edge 44 are not digging into the ground under the pavement. The wedge portion 40 may be at an angle to raise the pavement 20 a small distance without using too much energy and the anvil 42 may be at an angle to the wedge 40 to help crack the pavement 20 at the interface thereof and to hold the pavement perpendicular to the travel of the hammers 50 such that the hammer blows are perpendicular to the surface of the pavement for maximum effect. The leading edge 44, wedge 40 and anvil 42 may be separately replaced due to differing wear rates.

The anvil 42 is not attached to the machine frame directly but rests or floats on the road sub-base but is guided fore and aft by linkages to pull the wedge 40 and anvil 42. This arrangement limits the transmittal of shock that is not attenuated by the fracturing process. The linkage hinges employ rubber rings between bearing races.

The hammers 50 may be either gravity drop, hydraulic assisted, or pneumatic assisted hammers. The pneumatic assisted hammers provide more impact than gravity hammers since the pneumatic energy added will accelerate the hammers to provide more impact at strike. The hammers 50 may have a mass of up to about 5500 kilograms (12,125 pounds).

In a preferred embodiment as show in FIG. 4 the hammer 50 is shown as a hammer assembly. The hammer mass 51 has a pair of arms 52 connected at the top by a header block 56 and at the bottom by a hammer head 58 with teeth 59. The hammer mass 51 has an angled face 90 along the inside facing edges of arms 52 for engaging the angled face guide plate plastic wear strips 92 on the outer guide plate 80 and the mounting guide plate 82. The guide plates operate on the inside perimeter edges of the arms 52 to keep the hammer aligned straight up and down relative to the guide plates. The angled face 90 along the arms 52 and angled face guide plate plastic wear strips 92 on the outer guide plate 80 and the mounting guide plate 82 are made of a high density plastic which provides smooth slippery surfaces to slide along as the hammer mass slides up and down relative to the guide plates 80, 82 while holding the hammer in place to limit side to side movements which can result in a reduction in the force applied to the concrete. The length of the angled face guide plate plastic wear strips 92 on the guide plates 80, 82 provide for stably holding the hammer mass 51 in place as it slides up and down on the guide plates 80, 82. The angled face guide plate plastic wear strips 90, 92 are preferably at 45 degrees to the face and side of the hammer mass.

The outer guide plate 80 has slots for spacers 87 for guide plate lugs 85 on the guide plate spacers 81 of mounting guide plate 82 thus locking the guide plates 80, 82 together to form a guide for stabilizing the hammer mass 51 as it moves up and down. The guide plate spacers 81 provide for the guide plates 80, 82 to surround the cylinder 53 and the piston 84, which is centered within the hammer mass 51. The piston 84 is connected to the hammer mass 51 at the hammer head 58 by a rod connection 110 passing through an aperture in the hammer mass 51 and the base of the piston 116. The pin has a rubber collar 112 to help reduce shock and a retainer 114, which secures the rod connection 110 in place. A cushion 118 can also be used on top of the piston base 116 to help reduce shock between the piston 84 and the hammer mass 51.

The hydraulic cylinder 53 and the piston 84 are centered in the hammer mass 51 which is centered in the guide plates 80, 82 to provide for forces straight up and down without wasted side to side or front and back motions to decrease the efficiency of the hammer. The center of mass of the hammer mass 51 is in line with the center of the hydraulic cylinder 53 and piston 84 so that the mass will tend to not tilt or twist the hammer assembly 50 during use which wastes energy and contributes to vibrations and wear.

The hydraulic cylinder 53 has cylinder mounting collars 86 mounted thereon for attaching the outer guide plate 80 thereto. The outer guide plate 80 has apertures 89 for engaging the cylinder mounting collars 86 and cylinder mounting shock absorbers 88 preferably made out of rubber for surrounding the cylinder mounting collars 86 and being between the cylinder mounting collars 86 and the aperture 89. A cover plate 83 keeps the cylinder mounting shock absorbers in place. Hydraulic line 99 connects from a hydraulic pump (not shown) to hydraulic valve 98 on the hydraulic cylinder 53 to power the hammer retract.

In one mode of operation the hydraulic cylinder 53 is used to raise the piston 84 up into the cylinder 53 and the hammer mass 51 is then allowed to drop by gravity and hit the concrete 22 to be broken up. The teeth 59 at the base of the hammer head 58 of the hammer mass 51 hits the concrete and first cracks and then breaks up the concrete. The teeth 59 being spaced apart allows space along the surface of the concrete for breaking up the concrete and increasing the shock at the point where the teeth impact the concrete.

The concrete to be broken up is placed on an anvil 42 to increase the shock induced in the concrete by the hammer mass 51. The shock of the hammer blow is reflected by the anvil 42, which helps crack and then break up the concrete.

In another embodiment the cylinder 53 is a duplex cylinder having $N_2$ compressed by the hydraulic lifting of the piston 84 in the hydraulic cylinder 53. The compressed $N_2$ valve 95 and flex hose or piping 97 to reservoir 96 where it stays in compression until needed to accelerate the piston downward to increase the impact of the hammer mass 51 over a gravity drop hammer. When it is desired to increase the impact of the hammer mass 51 valve 95 is opened and the compressed $N_2$ passes from the reservoir 96 through flex hose or piping 97 to the hydraulic cylinder 53 and applies force to the piston to accelerate the hammer mass and increase the impact on the concrete. The hydraulic cylinder 53 thereby stores hydraulic force in the form of compressed gas on the upstroke of the hammer mass 51 to be used later in the downstroke. $N_2$ is the preferred gas in a duplex hydraulic cylinder because it does not have a diesel effect acting with hydraulic oil leakage.

The hammer assembly 50 has a pivotable connection to the mounting plates 104 by a mounting hinge pin 94 through apertures in the mounting hinge and apertures on the guide plate mounting 102. The pivoting of the guide plate 82 allows the hammer mass 51 to be tilted downward for servicing and for transportation. Further, the pivoting is useful for angling the hammer head 58 to be perpendicular to the concrete surface to be broken up. The top portion of guide plate mounting 82 has anti-bind rods 120 for adjusting the angle of the hinge mounting plate 92 and therefore the hammer mass 51. A spring 122 between the anti-bind rod 120 and the mounting hinge plate 92 allows the hammer head 58 and teeth 59 to be angled slightly so as to be easier to lift off the concrete rather then be pinched by or angled into the concrete and thereby be caught and harder to lift out of the concrete. The hydraulic cylinder 53 then expends less energy lifting the hammer mass 51 after it impacts the concrete. The pivot angle for lift out is important when the hammer is on a moving vehicle since the concrete will be changing position under the hammer when the hammer teeth 59 are imbedded in the concrete.

The mounting hinge bracket 104 is attached by bolting to the hinge mounting plate 92 and to a mounting support 105 which is attached to a frame of a vehicle by brackets 106 to mount the hammer assembly for use on a pavement removal machine.

A plurality of hammer assemblies 50 attached to the mounting support 105 each hitting at different times can efficiently break a road surface or other wide concrete product apart. In a preferred pattern of hammering there are five hammers, first one of the outside hammers 50 hits the pavement then the other outside hammer, then an inside hammer then the other inside hammer and then the center hammer. In this manner first the outside edges of the road are broken then a middle portion and then the center.

For the hammer assembly 50 shown in FIG. 4 the hammer mass 51, guide plates 80, 82, and hydraulic cylinder 53 are all positioned to minimize the effects of friction on hammer mass 51 velocity. This is assured by the down stroke of the cylinder piston 84 to be directly in line with the hammer mass 51 center of gravity and guide plates 80,82 that act parallel and in symmetry with the driven motion. The hammer assembly 50 is mounted on a hinge assembly 101 arrangement that allows the hammer assembly 50 to rotate to a horizontal position for servicing.

The pivoting hinge assembly 101 axis may include shock isolation that is not attenuated by the fracturing process. The linkage pivot may employ rubber rings between bearing races.

Figure 5:
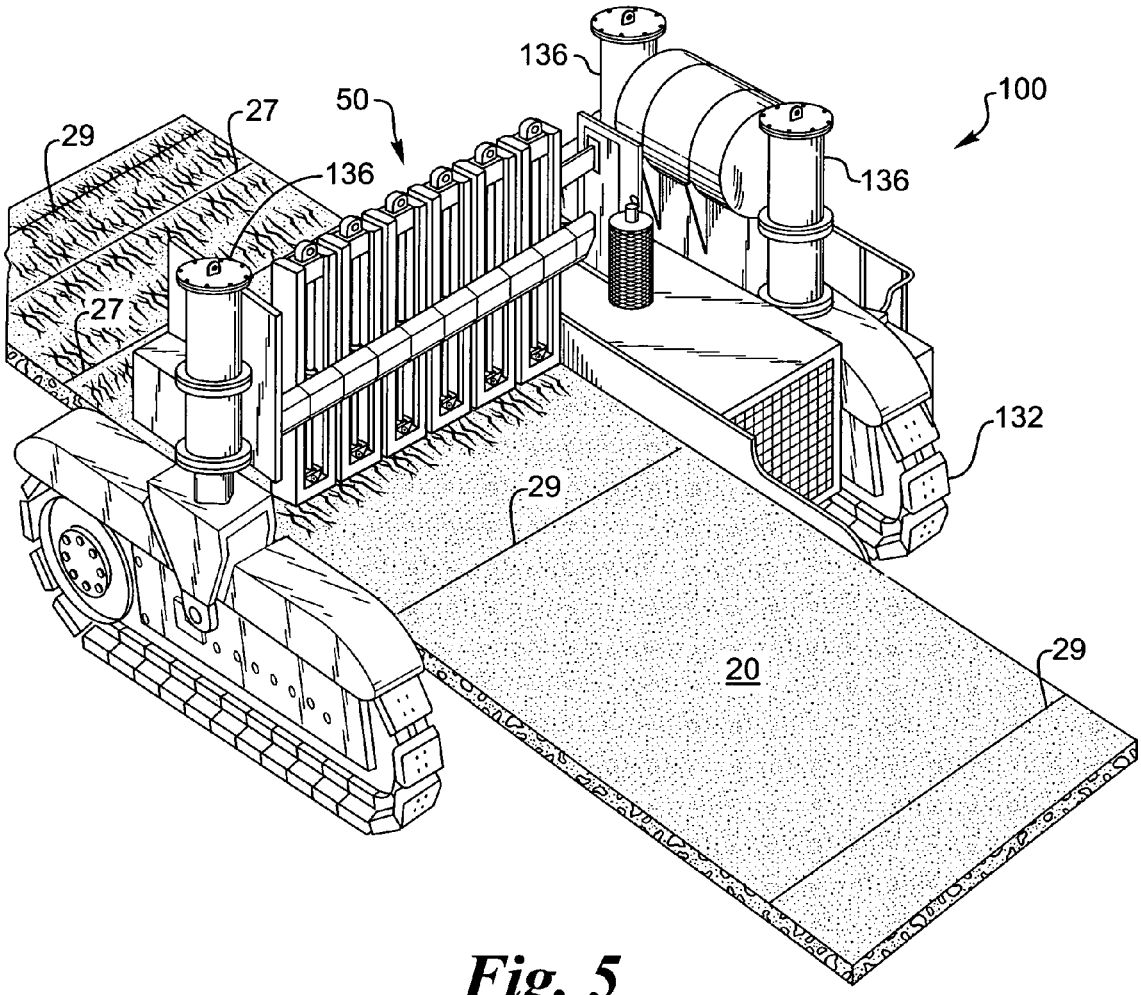
FIG. 5 is a perspective view of an alternate embodiment of the pavement removal machine lifting and cracking the roadway on the anvil.
Figure 6:
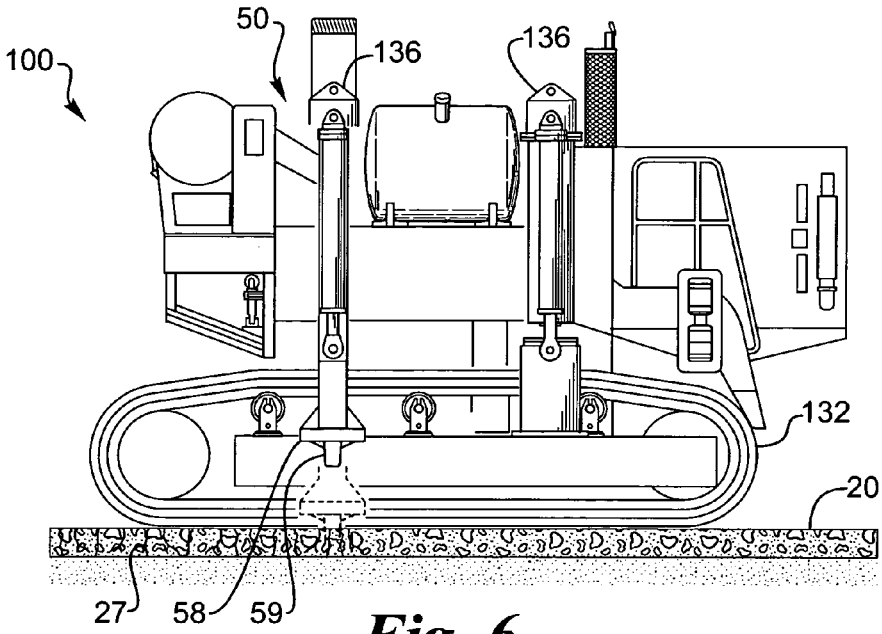
FIG. 6 is a side view of the pavement removal machine of FIG. 5 cracking the roadway only without use of an anvil.

In FIGS. 5-7 an alternative embodiment pavement removal machine 100 is presented where instead of four tracks 32, one at each corner of the frame, two tracks 132 are used. The tracks 132 are longer and centrally placed on the frame. As shown in FIG. 7 the pavement removal machine 100 is used to tear up pavement 20 and recycle the concrete 22 and steel rods or mesh 25 as in pavement removal machine 10. In pavement removal machine 100 machine leveling pistons 136 level the machine with respect to the pavement 20, and elevation and pitch control pistons 138 control the elevation and pitch of the anvil 42 and the wedge 40.

One problem encountered in removal pavement 20 are dips in the road which would impede the leading edge 44 and wedge 40 from lifting the pavement 20. The pavement removal machine 100 configured with just the hammer 50 for decracking the pavement 20 across the road in spaced part lines 27 will help resolve the problem of lifting the pavement 20 onto the anvil 42. Similarly if the pavement 20 has expansion separations 29 which are too far apart for the leading edge 44 and the wedge 40 to handle due to angles of lifting the pavement 20 then the pavement 20 can be decracked at shorter intervals 27. The pavement removal machine 100 has machine leveling pistons 136 to control the hammer 50 so that it is perpendicular to the pavement 20. The hammer 50 decracks the pavement 20 at designated places 27 prior to the pavement removal machines as shown in FIGS. 1 and 7 lifting up the pavement 20 and processing it for recycling.

Actuator bars 201, 202, 203 and 204 are used in conjunction with sensors which control the movement of the hammer by computer and valving.

Hoisting eye 225 is used in conjunction with a crane for lifting the hammer mass 51 out of the power hammer assembly 50 or placing the hammer mass 51 in the power hammer assembly 50. Since the hammer mass can be on the order of 2200-5500 kilograms (4850-12,125 pounds) a crane is needed to assemble the power hammer assembly 50 and to replace worn or broken hammers.

Obviously, many modifications and variations of the present invention are possible in light of the above teachings. It is therefore to be understood that, within the scope of the appended claims, the invention may be practiced otherwise than as specifically described.

What is claimed is:

1. A pavement removal machine comprising:

a frame, a means for supporting and propelling the frame on either side of the frame, a leading edge pivotally attached to the frame, the leading edge for engaging and lifting a reinforced concrete pavement having reinforcement rods therein from a roadbed, an anvil pivotally attached to the frame proximate the leading edge for receiving the reinforced concrete pavement from the leading edge, at least one hammer pivotally attached to the frame, the hammer engaging the reinforced concrete pavement by impacting the top surface of the pavement perpendicular to the surface thereof while the bottom surface of the pavement is resting on the anvil thereby breaking the concrete into aggregate, and removing it from the reinforcement rods in the reinforced concrete pavement, a wedge between the leading edge and the anvil, a means for adjusting the angle of the wedge relative to the leading edge and the anvil and, a saw for sawing the reinforcing rods to desired lengths.

2. A pavement removal machine as in claim 1 having, the means for supporting and conveying the frame comprises an arm pivotally attached to each corner of the frame, each arm having a leg pivotally connected to the arm and connected to a pod having a track for supporting and moving the pavement removal machine on the ground, the legs being vertically adjustable on the arms, such that the height of the frame can be adjusted to a desired height relative to the ground, and wherein the arms pivot to adjust the position of the pods on either side of the frame.

3. A pavement removal machine as in claim 1 having, a conveyor belt under the grating for removing the aggregate and depositing the aggregate in a desired location.

4. A pavement removal machine as in claim 1 having, a bin attached to the frame aft of the saw for receiving cut lengths of reinforcing rods.

5. A pavement removal machine as in claim 1 having, a means for adjusting the angle of the anvil relative to the frame.

6. A pavement removal machine as in claim 1 having, a means for adjusting the angle of the leading edge relative to the frame.

7. A pavement removal machine as in claim 1 having, a means for adjusting the angle of the hammer relative to the frame.

8. A pavement removal machine as in claim 1 having, one track on each side of the frame for supporting and moving the pavement removal machine.

9. A pavement removal machine as in claim 7 having, at least one piston connected between the frame and each track to adjust the height of the frame relative to the track.

10. A pavement removal machine as in claim 1 having, a pivotally adjustable wedge between the leading edge and the anvil to lift the pavement to a desired height.

11. A pavement removal machine as in claim 3 having, a bin for attached to the frame aft of the saw for receiving cut lengths of reinforcing rods.

12. A pavement removal machine as in claim 10 having, a means for adjusting the angle of the leading edge relative to the frame.

13. A pavement removal machine as in claim 11 having, a means for adjusting the angle of the anvil relative to the frame.

14. A pavement removal machine as in claim 12 having, a means for adjusting the angle of the hammer relative to the frame.

15. A pavement removal machine as in claim 13 having, a means for adjusting the angle of the wedge relative to the frame.

* * * * *